US006969433B1

(12) United States Patent
Bley et al.

(10) Patent No.: US 6,969,433 B1
(45) Date of Patent: Nov. 29, 2005

(54) GRANULATED GAS CHARGES

(75) Inventors: Ulrich Bley, Nürnberg (DE); Klaus Redecker, Nürnberg (DE); Waldemar Weuter, Fürth (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/030,007

(22) PCT Filed: Apr. 26, 2000

(86) PCT No.: PCT/EP00/03696

§ 371 (c)(1),
(2), (4) Date: Nov. 29, 2001

(87) PCT Pub. No.: WO00/64840

PCT Pub. Date: Nov. 2, 2000

(30) Foreign Application Priority Data

Apr. 27, 1999 (DE) ..... 199 19 065

(51) Int. Cl.[7] ..... C06B 45/10; C06B 29/02
(52) U.S. Cl. ..... 149/19.1; 149/77

(58) Field of Search ..... 149/77, 19.1

(56) References Cited

U.S. PATENT DOCUMENTS

| | | | | |
|---|---|---|---|---|
| 2,988,438 | A | 6/1961 | Allovio | |
| 4,214,438 | A * | 7/1980 | Hamilton et al. | 60/205 |
| 4,997,496 | A * | 3/1991 | Wehrli | 149/18 |
| 5,125,684 | A * | 6/1992 | Cartwright | 280/736 |
| 5,525,170 | A * | 6/1996 | Stark et al. | 149/85 |
| 5,633,476 | A * | 5/1997 | Cioffe | 149/109.6 |

FOREIGN PATENT DOCUMENTS

| | | |
|---|---|---|
| DE | 44 23 088 A | 1/1996 |
| EP | 0 543 026 | 5/1993 |
| WO | 22954 | 8/1996 |

* cited by examiner

*Primary Examiner*—Aileen Felton
(74) *Attorney, Agent, or Firm*—Scott A. McBain

(57) ABSTRACT

The invention relates to granulated gas charges and their use. Said granulated gas charges, whose combustion fumes are nitrogen-free and low in carbon monoxide, contain a) between 5 and 50% by weight binders; b) between 0 and 90% by weight oxidizing agents; and/or c) between 0 and 75% of an organic, notably nitrogen-free, fuel.

28 Claims, No Drawings

GRANULATED GAS CHARGES

The subject-matter of the invention relates to granulated gas charges and also to the use thereof.

The current process for the production of gas charges, for example for motor-vehicle safety, consists in pressing the raw materials to form tablets. The desired combustion processes can be achieved with these tablets. The disadvantages of this technology lie in the cost-intensive production of the tablets and the high pressures that are required in order to attain firmness when pressing, in particular with regard to safety. Usually, the raw materials are mixed together and pressed in the dry state or, if applicable, with small proportions of pressing aids.

In comparison with this, the object of the present invention consists in making novel granulated gas charges available.

The object of the invention mentioned above is achieved by means of granulated gas charges that have combustion vapours that are free of nitrogen oxide and are deficient in carbon monoxide and which contain a) binding agents in a quantity of 5 to 50% by weight, b) oxidizing agents in a quantity of 0 to 90% by weight, and/or c) organic, in particular nitrogen-free, fuels in a quantity of 0 to 75% by weight.

The subject-matter of the present invention relates in particular to combinations of binding agents, metal salts of oxidizing acids and/or organic, preferably nitrogen-free, fuels for use, for example, in gas generators as pyrotechnic mixtures for the generation of gases. The gas charges are obtained as a result of granulation of the components from a solvent-containing suspension of the components by means of the addition of water.

The gas charges that are defined in accordance with the invention are distinguished by combustion vapours which are free of nitrogen oxide and have clearly reduced amounts of carbon monoxide and by a high level of thermal stability in comparison with usual materials produced on a nitrocellulose base as the sole energy carrier. Furthermore, they are distinguished by the simple production process and the control of the combustion speed connected therewith by way of grain size, aggregates and coating compositions. The gas charges that are defined in accordance with the invention are preferably based on mixtures of nitrogen-free components as energy carriers and binders with proportions by weight of 5 to 50% by weight, such as cellulose acetate, cellulose acetobutyrate, cellulose triacetate, nitrocellulose (here a subordinate quantity functioning as a binding agent) and polyvinyl butyral.

Oxidising agents that can be used are perchlorates, for example of the alkali and alkaline earth metals, zinc peroxide, iron oxides, cerium dioxide, copper oxide, permanganates, tin dioxide and manganese dioxide. Potassium perchlorate and zinc peroxide in proportions by weight of 0 to 90% by weight are preferably used.

Organic nitrogen-free fuels, such as, for example terephthalic acid, fumaric acid and/or ascorbic acid, can be added in proportions by weight of 0 to 75% by weight. Furthermore, aluminium oxide, zinc oxide, silicates of the alkali and alkaline earth metals, clays of differing compositions, cement, gypsum, carbonates of the alkali and alkaline earth metals, oxalic acid, for example oxalates of the alkali and alkaline earth metals, can be used as aggregates to moderate combustion.

Substances such as graphite, water glass, nitrates and perchlorates of the alkali and alkaline earth elements are suitable as coating additives.

In a preferred embodiment, the gas charges that are defined in accordance with the invention are produced by granulation to form a kind of "ball powder". By a "ball powder" is usually understood a propellent charge powder that consists of spherical powder elements and which is usually produced according to a special process developed by Olin Mathieson, USA. A high-percentage nitrocellulose solution in a solvent that cannot be mixed with water, for example methyl or ethyl acetate, is dispersed in water whilst stirring carefully in such a way that floating spheres are formed. By heating below the boiling point of the solvent, progressive reduction in the strength of solvents and thus hardening of the floating spheres is achieved.

Since the spherical form is not favourable (is particularly degressive) in terms of interior ballistics, usually far-reaching surface treatment is effected in order to surround a core that burns comparatively quickly with a shell that burns more slowly. The process for the production of the gas charges in accordance with the invention is thus distinguished by ease of handling and a high level of safety, since here operations are almost exclusively carried out with components that are moist with solvent and/or water.

The binding agents that are defined in accordance with the invention are dissolved in a suitable solvent (for example methyl acetate) and, after dissolution of the binder, the oxidizing agent and the aggregates are added thereto. In order to precipitate the granulated material, water is added whilst stirring. Water-soluble components can then be used after previous suitable coating or by encapsulation. It is possible to work with correspondingly saturated solutions using residual solubility that still exists. It is possible to control the geometry, grain-size distribution and bulk density of the granulated material as a function of the quantity of solvent, the speed with which the water is added dropwise and the speed of stirring. After drying the granulated material, the handling safety and combustion behaviour can be modified in a manner known, per se, by means of coating additions. The coatings can either be deposited by applying the dry substances or by spraying in accordance with methods known per se.

Granulated materials for the purposes of the present invention describe the term derived from small grains for accumulations of small granulated grains. A granulated grain is thus an asymmetrical agglomerate consisting of powder particles (whole crystals, crystal fragments or particles). In contrast with the pellet, but like an agglomerate, it has no harmonic geometric form; the form of a sphere, a small bar, a cylinder and so on is only approximate and is only hinted at. The surface as a rule is uneven and jagged, the mass in many cases being more or less porous.

An important criterion of the gas charges in accordance with the invention relates to the combustibility of the spherical powder. Possible combinations of the constituents a), b) and/or c) result in compositions which cannot, however, be termed combustible ball powder for the purposes of the present invention. For the purposes of the present invention, a combustible ball powder, and thus a ball powder that is in accordance with the invention, is denoted by such a process in which the powder continues to burn after ignition even if the ignition source is removed.

The gas charges that are defined in accordance with the invention are suitable in particular for use in motor-vehicle systems, such as, for example, belt-tighteners or air bags, and industrial cartridges for gas-generation, for example in bolt-driving equipment. The gas charges that are defined in accordance with the invention are distinguished by non-poisonous combustion vapours and combustion residues.

EXEMPLIFYING EMBODIMENTS

The following three examples show how the gas charges in accordance with the invention behave with regard to combustion fumes and thermal stability.

EXAMPLES

The composition (% by weight) and the characteristic data in terms of safety techniques of the mixtures of Examples 1 to 3 are indicated in Table 1. The specified components for the mixtures in accordance with the invention were weighed out in the weight ratios indicated and added to the binding agents dissolved in methylacetate. Subsequently, water was added whilst stirring and the granulated material that was formed was filtered off. After drying, the granulated material was sieved and could undergo surface-treatment. The sensitivity to friction and impacts was measured in accordance with methods of the Bundesanstalt für Materialforschung und -prüfung (BAM), which are also described, for example, in J. Köhler, R. Meyer, Explosionasstoffe, 8th edition 1995, published by VCH Verlagsgesellschaft Weinheim. The detonation point was determined by means of thermal gravimetric analysis (Mettler) and the heat of explosion was measured with a calorimeter ex EKA.

TABLE 1

Overview of the mixture of Examples 1 to 3

| | Example 1 | Example 2 | Example 3 |
|---|---|---|---|
| Components in weight % | | | |
| Cellulose acetate | 25 | 12 | 20 |
| Cellulose acetobutyrate | | 10 | |
| Potassium perchlorate | 75 | 73 | 57 |
| Calcium carbonate | | 5 | |
| Aluminium oxide | | | 23 |
| Sensitivity to friction | 360 N | 360 N | 360 N |
| Sensitivity to impact | 10 J | 10 J | 15 J |
| Detonation Point | 340° C. | 330° C. | 340° C. |
| Heat of explosion | 4300 J/g | 4080 J/g | 3500 J/g |
| Weight loss after 240 hours at 145° C. | 0.5% | 0.04% | |

In order to determine the combustion properties, combustion tests were carried out in a closed 25 ml high-quality steel pressure bomb. For this purpose, the combustion tests were carried out with a 3 g weighed sample of the mixtures of the examples, with ignition being effected by means of an incandescent filament and 0.2 g of an ignition mixture consisting of boron/potassium nitrate and the pressure-time curve being plotted by means of a piezoelectric measuring system. A compilation of the pressure-rise times ($\Delta t$) is given in Table 2, with the percentages relating to the pressure maximum. The composition of the combustion vapours was determined with the aid of a thermodynamic computing program (ICT Code) and is presented in Table 2.

| | Example 1 | Example 2 | Example 3 |
|---|---|---|---|
| Pressure bomb results | | | |
| Weighed sample [g] | 3 | 3 | 3 |
| Pmax [bar] | 850 | 691 | 506 |

-continued

| | Example 1 | Example 2 | Example 3 |
|---|---|---|---|
| $\Delta t_{(10-90\%)}$ [ms] | 2.6 | 2.7 | 6.1 |
| $\Delta t_{(25-75\%)}$ [ms] | 1.1 | 1.2 | 2.5 |
| Gas composition | | | |
| Carbon dioxide [Vol %] | 56 | 57 | 57 |
| Water [Vol %] | 43 | 42 | 42 |
| Nitrogen monoxide [Vol %] | 0 | 0 | 0 |
| Carbon monoxide [Vol %] | <0.0001 | <0.0001 | <0.0001 |

What is claimed is:

1. Granulated gas charges having combustion vapors that are free of nitrogen oxide and are deficient in carbon monoxide, comprising a) 5 to 50% by weight of a binding agent;

b) oxidizing agents in a quantity 0 to 90% by weight of an oxidizing agent; and c) 0 to 75% by weight of an organic fuel.

2. Gas charges according to claim 1, wherein the binding agent is at least one binder selected from the group consisting of cellulose acetate, cellulose acetobutyrate, cellulose triacetate, nitrocellulose and polyvinyl butyral.

3. A gas charge according to claim 1, wherein the is at least one oxidizing agent is selected from the group consisting of from alkali perchlorates, alkaline earth metal perchlorates, zinc peroxide, iron oxides, cerium dioxide, copper oxide, manganese dioxide and permanganates.

4. A gas charge according to claim 1, wherein the at least one oxidizing agent is potassium perchlorate.

5. A gas charge according to claim 1, wherein the at least one organic fuel is acids selected from the group consisting of terephthalic acid, fumaric acid and ascorbic acid.

6. A gas charge according to claim 1, wherein the gas charges further comprise at least one aggregate.

7. A gas charge according to claim 6, wherein said aggregate is a combustion moderator.

8. A gas charge according to claim 6, wherein the aggregate is selected from the group consisting of aluminum oxide, zinc oxide, alkali metal silicates, alkaline earth metal silicates, mineral clays, cement, gypsum, alkali metal carbonates alkaline earth metal carbonates, alkali metal oxalates, alkaline earth metal oxalates, and oxalic acid.

9. A gas charge according to claim 1, wherein the gas charges further comprise a coating additives selected from the group consisting of graphite, water glass, nitrates of alkali metal, perchlorates of alkali metals, nitrates of alkaline earth metals and perchlorates of alkaline earth metals.

10. A gas charge consisting of from 57–75 percent by weight potassium perchlorate and from 12 to 25 weight percent cellulose acetate and 23 weight percent aluminum oxide.

11. A gas charge consisting of 20 percent by weight cellulose acetate, 57 percent by weight potassium perchlorate, and 23 percent aluminum oxide.

12. The gas charge of claim 1, consisting of cellulose acetate, potassium perchlorate, terphthalic acid.

13. The gas charge of claim 6, consisting of cellulose acetate, potassium perchlorate, aluminum oxide and terphthalic acid.

14. The gas charge of claim 9, consisting of cellulose acetate, potassium perchlorate, aluminum oxide, graphite and terphthalic acid.

15. The gas charge of claim 1, wherein said carbon monoxide is present as less than 0.0001 vol. % of the combustion vapor.

16. The gas charge of claim 15, wherein the combustion vapor contains from 56–57 vol % carbon dioxide.

17. The gas charge of claim 16, wherein the combustion vapor contains from 42–43 vol % water.

18. A composition consisting of 25 wt % cellulose acetate and 75 wt % potassium perchlorate.

19. A composition consisting of 20 wt % cellulose acetate, 57% potassium perchlorate, and 23% aluminum oxide.

20. A gas charge, comprising a) 1 to 50% by weight of at least one binding agent;

b) at least one oxidizing agent; and c) at least one nitrogen free organic fuel, wherein said gas charge is nitrogen free.

21. The gas charge of claim 20, wherein combustion vapors from the gas charge are free of nitrogen oxide and are deficient in carbon monoxide.

22. A gas charge, comprising a) 1 to 50% by weight of at least one binding agent;

b) at least one of an oxidizing agent and a nitrogen free organic fuel, wherein said gas charge is nitrogen free.

23. The gas charge of claim 22, wherein combustion vapors from the gas charge are free of nitrogen oxide and are deficient in carbon monoxide.

24. A gas charge comprising 1 to 50% by weight of at least one binding agent and an oxidizing agent, wherein said gas charge is nitrogen free.

25. The gas charge of claim 24, wherein combustion vapors from the gas charge are free of nitrogen oxide and are deficient in carbon monoxide.

26. The gas charge of claim 23, wherein said carbon monoxide is present as less than 0.0001 vol. % of the combustion vapor.

27. The gas charge of claim 24, wherein said carbon monoxide is present as less than 0.0001 vol. % of the combustion vapor.

28. The gas charge of claim 25, wherein said carbon monoxide is present as less than 0.0001 vol. % of the combustion vapor.

* * * * *